US005235913A

United States Patent [19]

Richardson et al.

[11] Patent Number: 5,235,913

[45] Date of Patent: Aug. 17, 1993

[54] LITHO START-OFF DEVICE AND METHOD OF STABILIZING AN OFFSET LITHOGRAPHIC PRINTING PRESS TO PRINT A PRECISE INK IMAGE

[75] Inventors: David M. Richardson, Elgin; Danny D. Brazelton, Hanover Park, both of Ill.

[73] Assignee: United States Can Company, Oak Brook, Ill.

[21] Appl. No.: 805,466

[22] Filed: Dec. 10, 1991

[51] Int. Cl.[5] ..... B41F 35/06

[52] U.S. Cl. ..... 101/425; 101/450.1

[58] Field of Search ..... 101/425, 450.1, 483

[56] References Cited

U.S. PATENT DOCUMENTS

| | | | |
|---|---|---|---|
| 1,178,907 | 4/1916 | Firm | 101/425 X |
| 2,944,484 | 7/1960 | Bruce | 101/425 |
| 3,016,826 | 1/1962 | Sage | 101/425 |
| 3,410,206 | 11/1968 | Dorr | 101/206 |
| 3,422,758 | 1/1969 | Brewster | 101/425 |
| 3,468,248 | 9/1969 | Giori | 101/167 |
| 3,693,547 | 9/1972 | Morgan | 101/425 |
| 4,072,106 | 2/1978 | Junghans et al. | 101/425 |
| 4,270,450 | 6/1981 | Difflipp et al. | 101/425 X |
| 4,393,778 | 7/1983 | Kaneko | 101/425 |
| 4,765,242 | 8/1988 | Oya et al. | 101/425 |
| 4,841,862 | 6/1989 | Seefried | 101/425 |
| 4,922,821 | 5/1990 | Nozaka et al. | 101/425 |
| 4,953,463 | 9/1990 | Hara | 101/425 |
| 5,069,124 | 12/1991 | Schneider | 101/142 |

FOREIGN PATENT DOCUMENTS

| | | | |
|---|---|---|---|
| 3910557 | 10/1990 | Fed. Rep. of Germany | 101/425 |
| 2040811 | 9/1980 | United Kingdom | 101/425 |

*Primary Examiner*—Edgar S. Burr
*Assistant Examiner*—Stephen R. Funk
*Attorney, Agent, or Firm*—Leydig, Voit & Mayer

[57] ABSTRACT

A litho start-off device for a lithographic printing press, comprising an ink removal cylinder mounted so that it may be engaged with the blanket cylinder to provide a line of contact between the cylinders for the transfer of an ink image there between when driven in synchronism, and a scraper for removing ink from the surface of the removal cylinder so that it continuously presents a clean surface to the blanket cylinder. The device and the method of using the device eliminate or substantially reduce the amount of start-off or waste material required to stabilize the press prior to beginning a commercial run.

15 Claims, 4 Drawing Sheets

LITHO START-OFF DEVICE AND METHOD OF STABILIZING AN OFFSET LITHOGRAPHIC PRINTING PRESS TO PRINT A PRECISE INK IMAGE

FIELD OF THE INVENTION

The invention relates generally to lithographic printing presses and more specifically to the initialization and stabilization of a production run on such presses.

BACKGROUND OF THE INVENTION

The offset lithographic process is used for printing various mediums, which may be in sheet or web form. For example, the process is used in the metal can industry for printing product labels on sheets of steel, which typically run on the order of 30–40 inches square. Offset lithographic presses can be arranged two, three or more in a line so that multiple colors can be printed on a sheet or web during a single pass through a press line. In paper operations, 4–6 presses are common, while for metal decorating 2–3 presses are more typical. In order to print complex labels, the metal sheets frequently must be passed through the press line several times.

By the very nature of the offset lithography printing process, when a new job is set up, the press must be adjusted and stabilized before it is ready to produce an accurate and acceptable image on the printed material. Specifically, adjustments are made to the press color and/or registration during start up, after which a certain amount of waste material must be run inasmuch as it takes time for the effect of the adjustments to carry through to the printed material. This period of time is generally referred to as the "run-in" period. Stabilization of the press during the run-in period is further complicated as sheets are passed through multiple presses in a press line.

An offset lithographic press generally includes a combination of cylinders, usually a single plate cylinder, a blanket cylinder, and an impression cylinder, disposed in a parallel contacting arrangement. A press plate made of stainless steel, aluminum, or the like containing the image of art to be printed is mounted on each plate cylinder. Typically, an ink fountain along with ink distribution rollers supply ink to the surface of the press plate on the outer peripheral surface of the plate cylinder. In offset lithography a similar arrangement provides water to the surface of the press plate. The blanket cylinder, on which a printing blanket is mounted, transfers the ink from the press plate to the medium being printed. The printed material is fed through the nip between the blanket cylinder and the impression cylinder, which provides support for the medium to ensure accurate transfer of the ink image from the blanket.

During the run-in period noted above, it is necessary to operate the press in order to apply the ink and water to the press plate and transfer the image from the plate to the blanket in order to stabilize the press and the image on the printing blanket. During this period, ink will build up on the blanket and must be removed. This traditionally has been accomplished by running a sufficient amount of waste material through the press so as to stabilize the transfer of the ink image by the press. This cycle is repeated each time an adjustment to color or registration is made on the press. While running waste paper on a paper press may be costly to a printer, the cost of running start-off metal sheets in metal printing operations can represent a truly significant operating cost. Accordingly, in metal decorating there is usually an effort to use start-off sheets as sparingly as possible. Although for this purpose it may be possible to recycle metal sheets that have been spoiled in other operations, new sheets must frequently be utilized at significant expense. Further, as these sheets must be used sparingly, the commercial run is often begun before the press has fully stabilized. This can result in variations in print quality for the first 100–200 production sheets.

Offset lithography press users, and the can industry in particular, have attempted to reduce the costs associated with the use of expensive start-off sheets through various methods. As far as the start-up quality problems are concerned, very little hope has been given in the past for a solution. On both fronts, a practical and economical solution is required.

OBJECTS OF THE INVENTION

It is a primary object of the invention to reduce the costs associated with preparing an offset lithographic press for a commercial run. It is a related object to substantially eliminate or reduce the amount of start-off or waste material utilized during the run-in period.

It is another object to provide means by which the press may be stabilized to produce an accurate image prior to the initiation of the commercial run. Yet another object is to provide a reliable and economical means of stabilizing the press which does not unduly complicate the construction of the press.

SUMMARY OF THE INVENTION

The invention includes a device and method for stabilizing an offset lithographic printing press to print a precise image on the surface of a material. The litho start-off device comprises an ink removal cylinder, the surface of which emulates the surface of the production sheets. The ink removal cylinder is disposed parallel to the blanket cylinder and mounted so that it can be selectively engaged and disengaged with a blanket disposed on the surface of the blanket cylinder. The ink removal cylinder is rotated with the same surface speed as the blanket. As the ink removal cylinder rotates while in contact with the blanket, the ink image is transferred from the surface of the blanket to the surface of the ink removal cylinder in the same manner as the ink is transferred to the production medium during actual operation. So that the ink removal cylinder continually presents a clean surface to the blanket for transfer of the ink image, the litho start-off device further includes means for removing ink from the surface of the ink removal cylinder. Consequently, the ink removal cylinder can be engaged and continue to receive the ink image during an extensive run-in period, so that the press may be fully stabilized before beginning a commercial run.

Use of the litho start-off device during the run-in period can eliminate completely or at least substantially reduce the amount of start-up material required to stabilize the press at start-up or when adjustments are made to the press. In this way, the device according to the invention can greatly reduce the costs associated with start-up or press adjustments. While this reduction in the cost of printing can be beneficial to any offset lithographic printing press user, this savings can be substantial in the metal decorating industry.

Further, use of the device according to the invention can allow the press to be stabilized for a longer run-in period without greatly increasing the associated costs. Consequently, the press can be substantially stabilized so that it will provide higher print quality when beginning its commercial run.

These and other features and advantages of the invention will be more readily apparent upon reading the following description of a preferred exemplified embodiment of the invention and upon reference to the accompanying drawings wherein:

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DETAILED DESCRIPTION OF THE PREFERRED EMBODIMENTS

Figure 1:
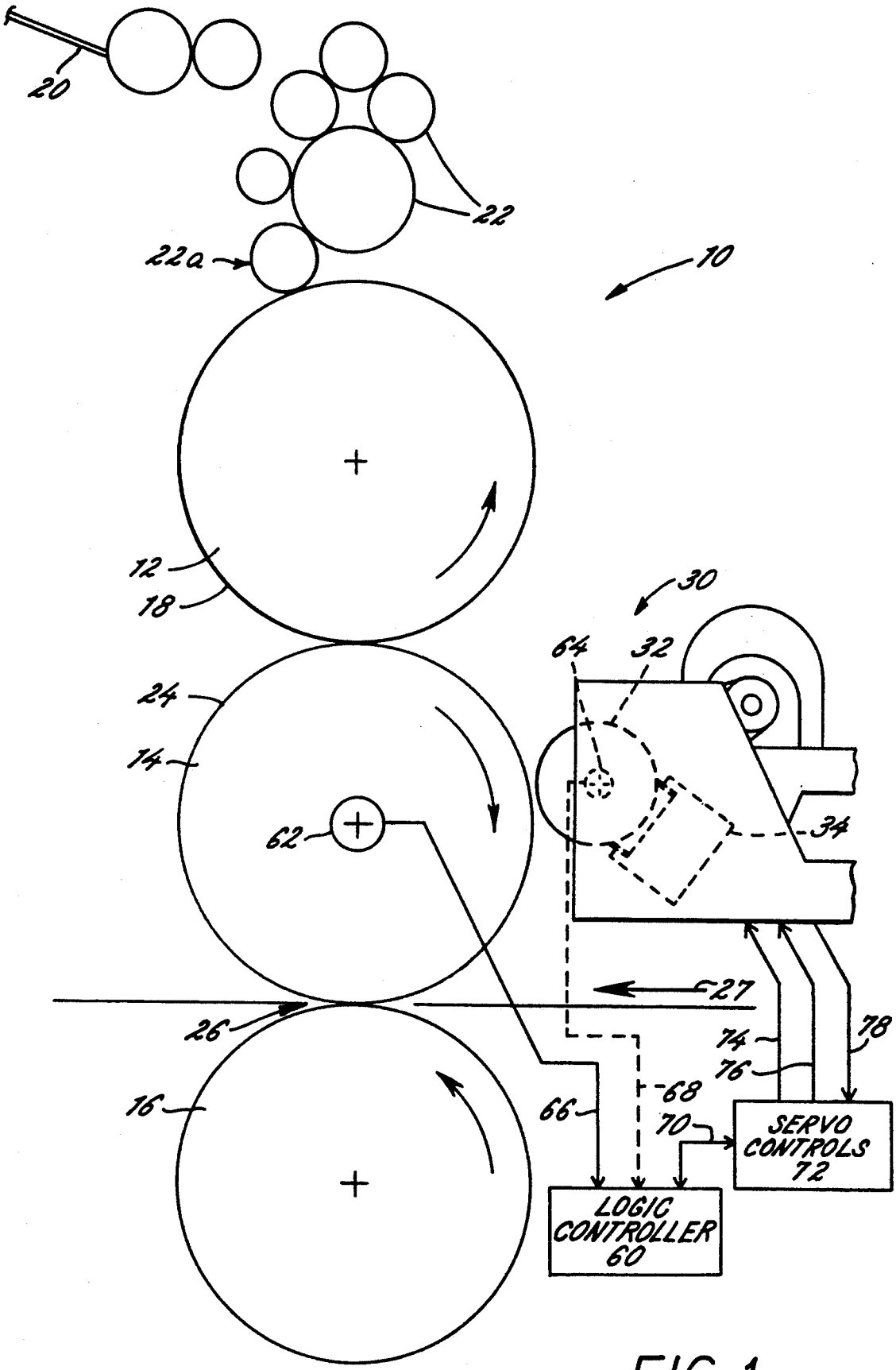
FIG. 1 is a schematic of an offset lithographic press constructed in accordance with the invention.

Turning now to the drawings, there is shown in FIG. 1 an offset lithography printing press 10. The press 10 includes a plate cylinder 12, a blanket cylinder 14, and an impression cylinder 16, which are disposed in a parallel arrangement forming lines of contact between the adjacent rollers. One or more press plates 18, which contain the image of art that is to be printed on a material, are mounted along the outside circumference of the plate cylinder 12. The press plate 18 is generally made of stainless steel, aluminum, or the like. A printing blanket 24 is mounted on the blanket cylinder 14 for transfer of the final ink image to the printed medium.

In order to supply ink to the surface of the image on the press plate 18, an ink fountain 20 and ink distribution rollers 22 are provided. A similar arrangement (not shown) provides water to the surface of the press plate 18. During operation, ink from the ink fountain 20 is applied to the ink distribution rollers 22, which evenly distribute the ink before it is picked up by the press plate 18 of the plate cylinder 12 as it rotates against an ink form roller 22*a*. The ink image on the press plate 18 is then picked up by the blanket 24 as the blanket cylinder 14 rotates in synchronism with the plate cylinder 12. The ink then transfers from the blanket 24 to the surface of the medium to be printed (not shown) as it is fed through the nip 26 formed between the blanket cylinder 14 and the impression cylinder 16. It will be appreciated that the impression cylinder 16 provides support for the medium to insure accurate transfer of the ink image from the surface of the blanket 24 to the surface of the medium. It will further be appreciated that the medium may be fed through the nip 26 (in the direction generally indicated by the arrow 27) by any appropriate means.

In accordance with the invention, a litho start-off device 30 is mounted in the press adjacent to the blanket cylinder 14. Although the device 30 is only schematically illustrated in FIG. 1 and a general overview of the operation of the device 30 outlined in this paragraph, a more detailed description of the specific structure and operation of a preferred embodiment will follow. As shown in FIG. 1, the device 30 includes an ink removal cylinder 32 that is rotatably mounted within the device 30, parallel to the blanket cylinder 14. The device 30 further includes means for moving the ink removal cylinder 32 into and out of engagement, so that the surface of the ink removal cylinder 32 contacts the blanket 24 along the circumferential surface of the blanket cylinder 14. The device 30 also includes means for driving the ink removal cylinder 32 in synchronism with the blanket cylinder 14, which is shown in detail in FIG. 2. The litho start-off device 30 also is provided with a scraper assembly 34. The scraper assembly 34 is disposed adjacent to the ink removal cylinder 32 and operates to continually remove the transferred ink image from the surface of the ink removal cylinder 32 as it rotates.

Figure 2:
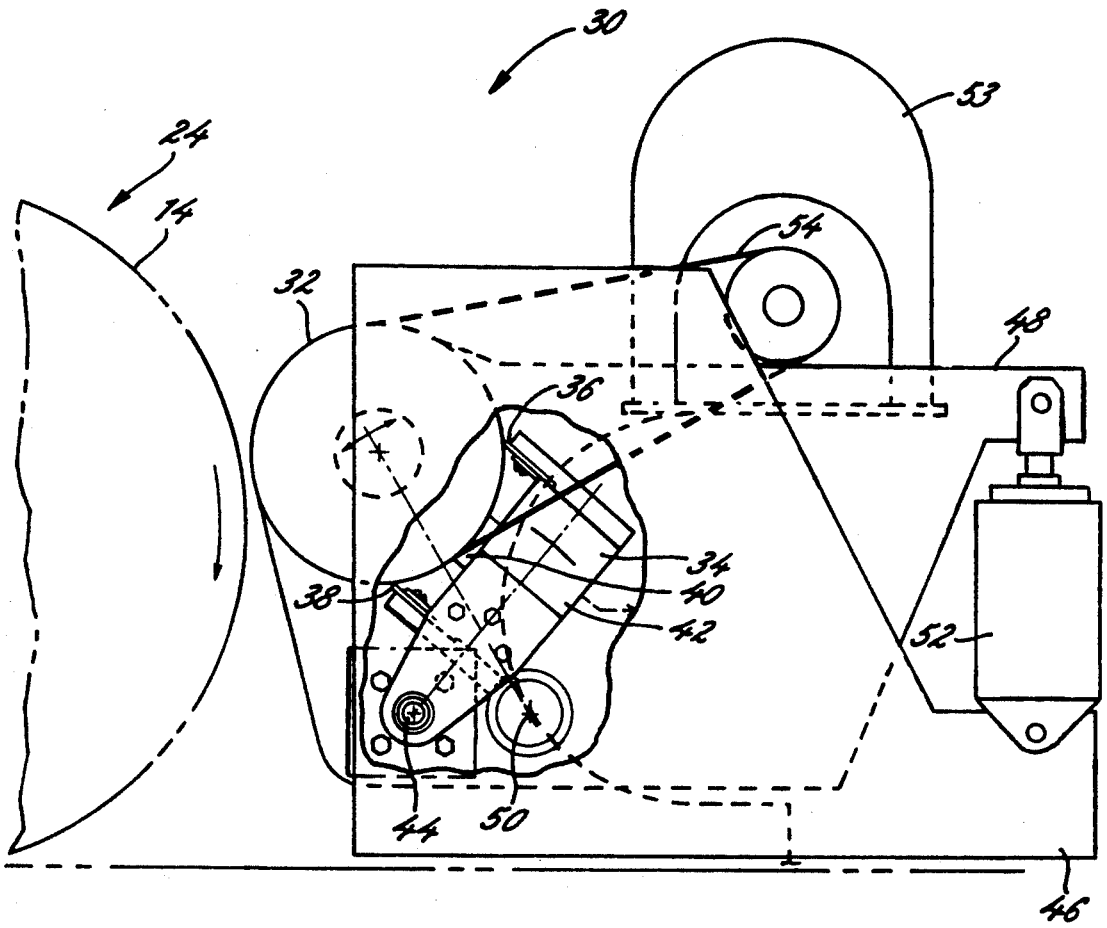
FIG. 2 is an enlarged view of the litho start-off device shown in FIG. 1, partially broken away.

Turning now to FIG. 2, there is shown a more detailed view of the litho start-off device 30 of FIG. 1. As indicated above, the ink removal cylinder 32 is disposed in the litho start-off device 30 parallel to the blanket cylinder 14. It is an important feature of the invention that the surface of the ink removal cylinder 32 has a finish rough enough to strip the ink from the blanket 24, and yet smooth enough to be efficiently cleaned by the scraper assembly 34. In this way, the surface of the ink removal cylinder 32 will receive ink from the blanket cylinder 14 in a manner similar to that of conventional start-off material. In the currently intended commercial embodiment, the cylinder 32 is cold rolled steel tubing, chrome plated and ground to a 4 $\mu$ finish.

Figure 4:
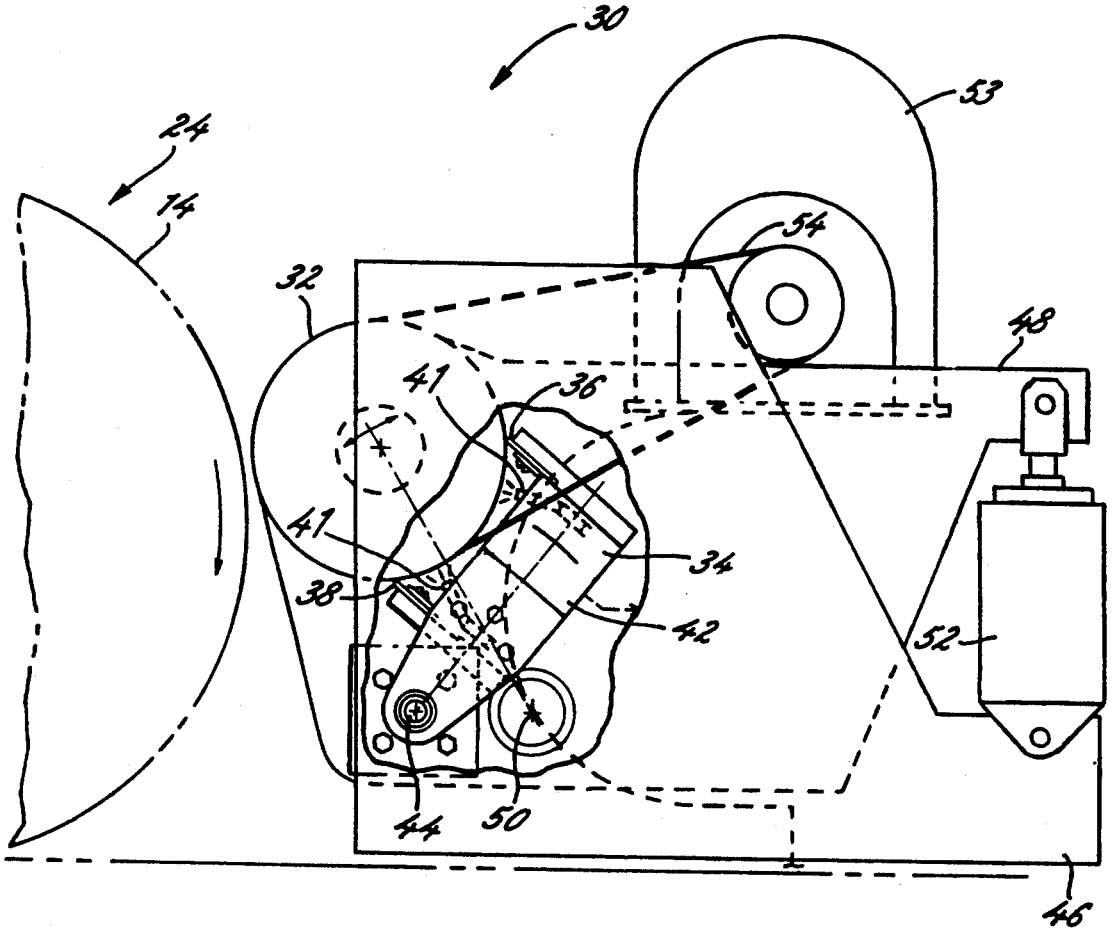
FIG. 4 is another embodiment of the litho start-off device shown in FIG. 2.

So that the ink removal cylinder 32 continually presents a clean surface to the blanket 24 for transfer of the ink image, the scraper assembly 34 is provided to continually remove ink from the surface of the ink removal cylinder 32. (The litho start-off device 30 shown in FIG. 2 is partially broken away to more clearly show the scraper assembly 34.) In the embodiment shown in FIG. 2, the scraper assembly 34 includes two scrapers 36, 38, and a solvent wiper 40 disposed along the surface of the ink removal cylinder 32 between the scrapers 36, 38. In one embodiment, scrapers are fabricated from the polymeric material, DELRIN proved satisfactory. Leather backed with spring steel has also given good results. Other appropriate materials, such as other polymers, rubber, or the like may also be employed. A solvent such as methyl ethyl ketone may be utilized with a felt pad in the solvent wiper 40. Alternately, the solvent may be sprayed or misted onto the surface of the ink removal cylinder 32 through one or more nozzles 41, as shown in another embodiment of the litho start-off device illustrated in FIG. 4. Returning now to the embodiment shown in FIG. 2, it is important that the solvent be distributed along the entire length of the pad to ensure satisfactory ink removal. It will be appreciated, however, that any cleaning means may be utilized that will adequately remove the ink from the surface of the ink removal cylinder 32, so long as the cylinder 32 is cleaned and is available for continuous removal of ink from the blanket 24. It will be further appreciated that the surface of the ink removal cylinder 32 must be adequately smooth to allow removal of the ink by the ink scraper assembly 34, in this embodiment, the scrapers 36, 38 and wiper 40.

In order to permit easy cleaning and replacement of the components of the scraper assembly 34, the scrapers 36, 38 and the solvent wiper 40 are mounted on a bracket 42, which hinges about point 44. Additionally, the assembly may be adjusted to seat against the surface of the ink removal cylinder 32 with a desired amount of force to ensure complete removal of ink from the cylinder 32. In a prototype wherein the scrapers 36 and 38 were fabricated from DELRIN, it was found that a force of 500 pounds provided acceptable contact between the scrapers and the surface of the blanket cylinder. However, satisfactory results have likewise been achieved using a single blade acting like a squeegee with less than 500 lbs. being applied.

As indicated above, the litho start-off device 30 is mounted within the press 10. In the embodiment shown in FIG. 2, the device 30 is mounted by way of a stationary bracket 46. Although only one end of the device 30 is illustrated, it will be appreciated that the opposite end has a similar mounting arrangement, i.e. a stationary bracket 46 may be provided at opposite end of the device 30 in order to secure it to the press 10. Although the device 30 is described as being mounted by a bracket 46 disposed at each end of the cylinder 32, one skilled in the art will appreciate that the device 30 may be mounted to the press 10 by any appropriate means that adequately secures the components therein.

In order to provide a line of contact between the ink removal cylinder 32 and the blanket 24 for transfer of the ink image from one surface to the other, means are provided whereby the ink removal cylinder 32 may be moved into engagement with the blanket cylinder 14. In the embodiment shown, the ink removal cylinder 32 is rotatably mounted to a bracket 48, which is pivotably mounted to stationary bracket 46. As with stationary bracket 46, it will be appreciated that a pivotable bracket 48 is provided at each end of the ink removal cylinder 32.

In order to pivot bracket 48 about pivot point 50, an actuating cylinder 52 is provided between arms of the stationary bracket 46 and the pivotable bracket 48. It will be appreciated that the actuating cylinder may be powered either hydraulically, pneumatically, or mechanically to pivot bracket 48 to engage or disengage the ink removal cylinder 32 with the blanket cylinder 14. In the preferred embodiment, the actuating cylinder 52 is powered pneumatically. According to an important aspect of the invention, the contact force between the cylinders 32, 14 must be great enough to allow the image to transfer, but not so great that it distorts the image on the surface of the blanket 24.

While the engagement means has been described herein with reference to a pivotable unit, it will be appreciated that the ink removal cylinder 32 may be moved into engagement by an alternate means. For example, the cylinder 32 may be moved into engagement in a linear fashion, by sliding the assembly into position.

In order to rotate the ink removal cylinder 32, an appropriate driving means is provided. In the embodiment shown, a servo motor 53 coupled to the ink removal cylinder 32 by means of a precision lug belt 54 drives the ink removal cylinder 32 at a desired speed. According to an important aspect of the invention, the surface speed of the ink removal cylinder 32 is precisely matched to the surface speed of the blanket 24. In this way, the ink image transfers between the cylinders 14, 32 without causing distortion of the image on the blanket 24. While this synchronization of the blanket cylinder 14 and the ink removal cylinder 32 may be accomplished by any appropriate means, electronic gearing is utilized in the preferred embodiment to obtain this synchronization. According to this method, the axis of the ink removal cylinder 32, or the slave axis, is programmed to track the axis of the blanket cylinder 14, or the master axis, at a specified ratio. In the embodiment shown, the ratio of the blanket cylinder to the ink removal cylinder is on the order of 1:2.5

Figure 3:
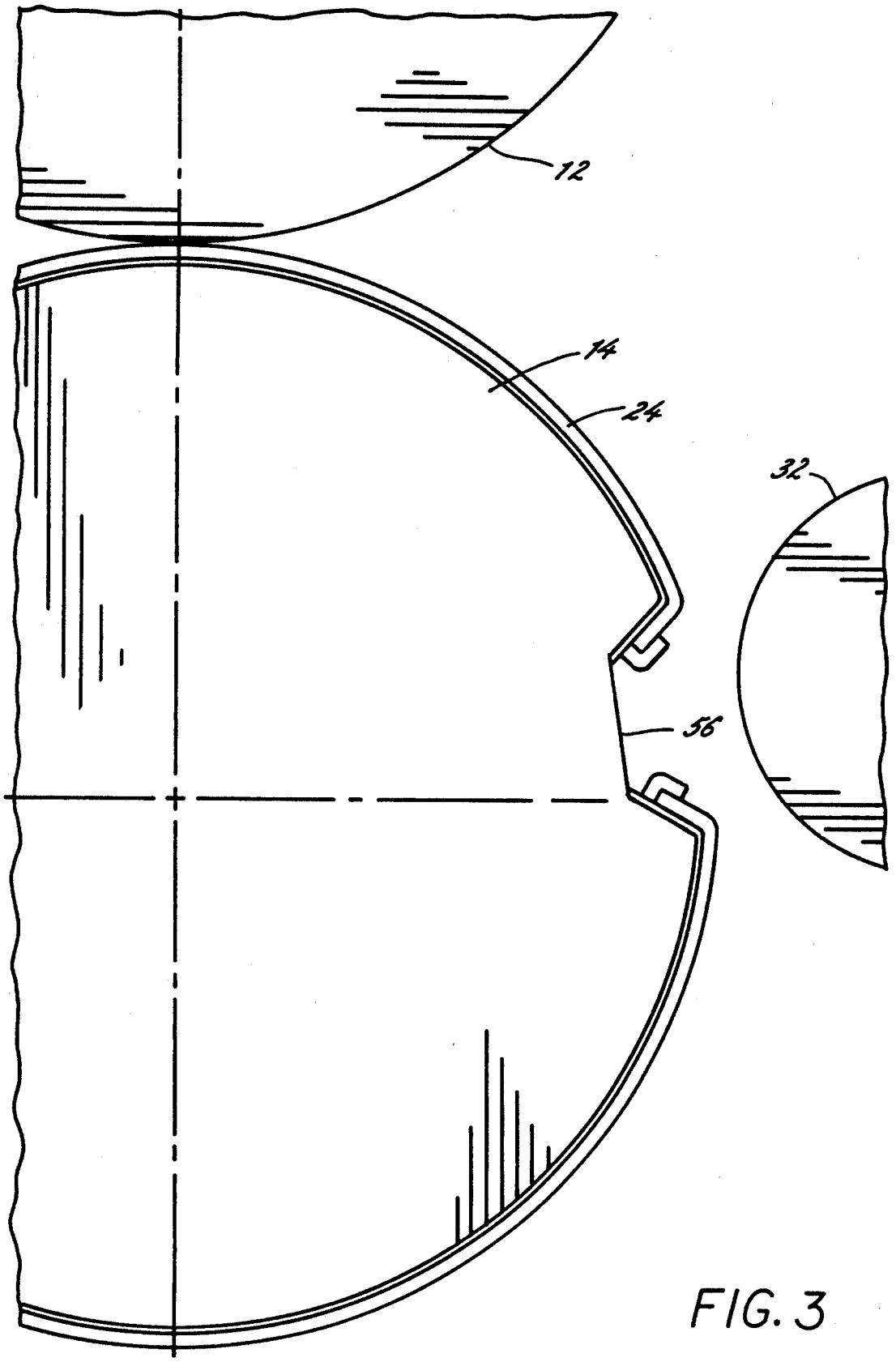
FIG. 3 is a fragmentary view of a portion of the press shown in FIG. 1.

According to another important aspect of the invention, the ink removal cylinder 32 must be engaged and disengaged from contact with the blanket cylinder 14 without disturbing the ink image on the blanket 24. As shown in FIG. 3, the blanket cylinder 14 generally contains a clamping section 56 along its surface. It will be appreciated that the engagement and disengagement of the ink removal cylinder 32 at the precise moment when the cylinder 32 is adjacent to this clamping section will minimize any distortion in the ink image on the blanket 24 due to the movement of the litho start-off device 30.

Returning now to FIG. 1, in order to control the timing of the engagement and disengagement process, as well as the speed of the ink removal cylinder, there is provided a logic controller 60 along with shaft encoders 62, 64, and various feedback devices. The shaft encoder 62 of the blanket cylinder 14 provides signals 66 to the logic controller 60 corresponding to the speed of the blanket cylinder 14, as well as the precise position of the blanket cylinder 14 and its clamping section 56 at any particular time. Similarly, the shaft encoder 64 of the ink removal cylinder 32 provides a signal 68 that corresponds to the speed of the ink removal cylinder 32. The logic controller 60 utilizes the information from the signals 66, 68 to provide a signal 70 to the servo controls 72. The servo controls 72 in turn provide signals 74, 76 to the servo motor 53, which provides a feedback signal 78 to the servo controls 72. In this way, the information from the shaft encoders 62, 64 is utilized to control the operation of the litho start-off device 30 by controlling the speed and movement of the ink removal cylinder 32.

In operation, when the press is first inked up or when adjustments are made to the setup of the press, the press is turned on. The shaft encoder 62 provides a signal 66 to logic controller 60 corresponding to the speed and position of the blanket cylinder 14. The logic controller in turn provides a signal 70 to the servo controls 72. The servo controls signal the servo motor 53 to rotate the ink removal cylinder 32 in synchronism with the blanket cylinder 14, and signal the logic controls of the actuating cylinder to engage the ink removal cylinder 32 with the blanket cylinder 14 as the clamping section 56 of the blanket cylinder 14 rotates past the litho start-off device 30. The feedback signal 78 from the motor 53 permits the servo controls 72 to continually adjust the speed of the ink removal cylinder 32 in order to precisely synchronize the speed with that of the blanket cylinder 14.

As the cylinders 14, 32 rotate in synchronism, ink is transferred from the blanket 24 to the surface of the ink removal cylinder 32. The scrapers 36, 38 and the solvent wiper 40 of the scraper assembly 34 remove the ink from the surface of the ink removal cylinder 32, so that the ink removal cylinder 32 continues to present to the blanket 24 a clean surface for receiving the ink image. In this way, the press can be operated for a sufficient length of time to allow true stabilization and consistency in image quality before the press begins a commercial run.

Once the press is stabilized and ready to run commercial sheets, the logic controller signals the sheet feeder (not shown) located at the front of the press line to start feeding sheets. The logic controller 60 then signals the servo controls 72 and the logic controls of the actuating cylinder 52 to disengage the litho start-off device 30 from the blanket cylinder 14 at the clamping section 56 at the moment when the first commercial sheet approaches the nip 26 between the blanket cylinder 14 and the impression cylinder 16.

We claim as our invention:

1. An offset lithographic printing press which prints an ink image on a material, comprising, in combination, an impression cylinder, a blanket cylinder having a circumferential surface, the blanket cylinder being disposed parallel and substantially adjacent to the impression cylinder to form a nip therebetween through which material is passed, a blanket disposed on the circumferential surface of the blanket cylinder for applying the ink image to the material passed through the nip, means for applying the ink image to the blanket, an ink removal cylinder having a circumferential surface which receives the ink image, means for engaging and disengaging the ink removal cylinder with the blanket cylinder such that the surface of the ink removal cylinder contacts the blanket when engaged, the ink removal cylinder contacting the blanket cylinder between the means for applying the ink image to the blanket and the nip, means for driving the ink removal cylinder in synchronism with the blanket cylinder so that the surface of the ink removal cylinder is at substantially the same speed as the blanket, and means for removing ink from the surface of the ink removal cylinder, such that when the ink removal cylinder is engaged with the blanket and the ink removal cylinder is driven in syncrhonism with the blanket cylinder, the surface of the ink removal cylinder is substantially free from ink as it approaches the blanket.

2. The press as claimed in claim 1 wherein the means for removing ink comprises means for applying a solvent to the surface of the ink removal cylinder, and at least one scraper disposed against the surface of the ink removal cylinder.

3. The press as claimed in claim 2 wherein the means for removing ink comprises two scrapers and a solvent applying pad disposed between the scrapers, the scrapers and the pad engaging the ink removal cylinder at a circumferential location which does not interfere with the engagement of the ink removal cylinder with the surface of the blanket cylinder.

4. The press as claimed in claim 2 wherein the at least one scraper comprises a polymeric material.

5. The press as claimed in claim 2 wherein the at least one scraper comprises leather.

6. The press as claimed in claim 2 wherein the solvent is methyl ethyl ketone.

7. The litho start-off device as claimed in claim 2 wherein the means for applying a solvent includes at least one nozzle through which the solvent is applied to the ink removal cylinder.

8. The press as claimed in claim 2 wherein the surface of the ink removal cylinder has a surface characteristic adequate to remove ink from the blanket, but smooth enough so that the scraper can remove ink therefrom.

9. The press as claimed in claim 1 wherein the means for driving the ink removal cylinder in syncrhonism with the blanket cylinder includes electronic gearing.

10. The press as claimed in claim 1 wherein the blanket cylinder includes a clamping segment and the means for engaging and disengaging the ink removal cylinder operates when the ink removal cylinder is adjacent the clamping segment.

11. The press as claimed in claim 1 wherein the means for engaging and disengaging disengages the ink removal cylinder once the ink image has been stabilized on the surface of the blanket cylinder.

12. A method of preparing an offset lithographic printing press to print a stable ink image on a surface of a material, the offset lithographic printing press comprising a blanket cylinder having a blanket disposed on its circumferential surface for applying the ink image to the material, means for rotating the blanket cylinder, means for applying the ink image to the blanket, an impression cylinder, an ink removal cylinder having a circumferential surface for receiving the ink image, means for engaging and disengaging the ink removal cylinder with the blanket cylinder, means for driving the ink removal cylinder in syncrhonism with the blanket cylinder, and means for removing ink from the surface of the ink removal cylinder, the method comprising the steps of:

rotating the blanket cylinder, applying the ink image to the blanket, disposing the ink removal cylinder parallel and substantially adjacent the blanket cylinder at a circumferential location between the means for applying the ink image to the blanket and the impression cylinder, driving the ink removal cylinder in syncrhonism with the blanket cylinder so that the surface of the ink removal cylinder is at substantially the same speed as the blanket, engaging the ink removal cylinder with the blanket cylinder so that the surface of the ink removal cylinder contacts the blanket along a line of contact such that the ink image is continually transferred from the blanket cylinder to the surface of the ink removal cylinder before the ink image reaches the nip, continually removing the ink image from the surface of the ink removal cylinder at a circumferential location spaced from the line of contact between the ink removal cylinder and the blanket such that a substantially clean surface of the ink removal cylinder is presented back to the blanket, and disengaging the ink removal cylinder once the quality of the image is substantially stabilized and suitable for printing.

13. The method as claimed in claim 12 herein the means for removing ink comprises at least one scraper disposed against the surface of the ink removal cylinder and means for applying a solvent to the surface of the ink removal cylinder, and the removal step includes applying the solvent to the surface of the ink removal cylinder and scraping the ink image from the surface of the ink removal cylinder.

14. The method as claimed in claim 13 wherein the solvent is methyl ethyl ketone.

15. The method as claimed in claim 12 wherein the blanket cylinder includes a clamping segment, and the engaging and disengaging steps comprise engaging and disengaging the ink removal cylinder when the ink removal cylinder is adjacent the clamping segment.

* * * * *